US009648953B1

(12) United States Patent
Kuo

(10) Patent No.: US 9,648,953 B1
(45) Date of Patent: May 16, 2017

(54) COLLAPSIBLE HANGING STORAGE ASSEMBLY

(71) Applicant: EP Family Corp., Walnut, CA (US)

(72) Inventor: Hung-Chih Kuo, Walnut, CA (US)

( * ) Notice: Subject to any disclaimer, the term of this patent is extended or adjusted under 35 U.S.C. 154(b) by 0 days.

(21) Appl. No.: 15/368,453

(22) Filed: Dec. 2, 2016

(51) Int. Cl.

| | |
|---|---|
| ***A47F 5/14*** | (2006.01) |
| ***A47B 88/90*** | (2017.01) |
| *A47F 5/00* | (2006.01) |
| *A47F 5/01* | (2006.01) |

(52) U.S. Cl.
CPC ..... *A47B 88/9418* (2017.01); *A47F 5/01* (2013.01); *A47F 2005/0012* (2013.01)

(58) Field of Classification Search
CPC ..... A47F 5/01; A47F 2005/0012; A47B 88/9412; A47B 88/9418
USPC ..... 211/113, 88.01, 126.1, 181.1; 220/4.28, 220/4.29, 4.31, 4.34, 6, 7, 485; 312/258, 312/348.1, 348.2; 108/60; D3/304, 305, D3/306; D6/566, 567
See application file for complete search history.

(56) References Cited

U.S. PATENT DOCUMENTS 181,639 A * 8/1876 Carver ..... A47H 27/00 140/71 R
323,339 A * 7/1885 Kilborn ..... B65D 7/26 220/485
434,044 A * 8/1890 Estey ..... A47B 88/0014 312/348.1
739,006 A * 9/1903 Johnson ..... B65D 7/26 220/6
785,451 A * 3/1905 Tourville ..... A01K 97/04 220/6
797,871 A * 8/1905 Smith ..... B65D 11/1833 220/485
803,200 A * 10/1905 Stripe ..... B65D 7/26 220/485
926,798 A * 7/1909 Wilson ..... A24F 19/0092 211/88.01
936,104 A * 10/1909 Ernest ..... B60J 3/0217 131/241
1,006,328 A * 10/1911 Widenhofer ..... D06F 57/08 211/181.1
1,169,328 A * 1/1916 Holtgrewe ..... B65D 9/18 217/16
1,171,924 A * 2/1916 Brown ..... B65D 7/26 220/485

(Continued)

*Primary Examiner* — Joshua J Michener
*Assistant Examiner* — Devin Barnett
(74) *Attorney, Agent, or Firm* — Tommy SF Wang; Wang IP Law Group, P.C.

(57) ABSTRACT

A collapsible hanging storage assembly mounts beneath a desk or flat surface. The assembly has panels and fastening mechanisms that collapse for stowage and easily construct to contain items. The assembly comprises a base panel defined by wire mesh, a pair of side edges, a rear edge, and a front edge. A pair of side panels hingedly join the side edges of base panel. The side panels include a pair of upper horizontal bars, a pair of lower horizontal bars, a pair of front vertical bars, and a pair of rear vertical bars. A pair of L-shaped brackets extend from the front vertical bars to mount on a desktop. The L-shaped brackets include a vertical member and a generally flat horizontal member. A rear panel joins the side panels and base panel perpendicularly and has an upper edge, a lower edge, a left edge, and a right edge.

10 Claims, 5 Drawing Sheets

(56) References Cited

U.S. PATENT DOCUMENTS 2,333,954 A * 11/1943 Rocker ..... B65D 71/0011 206/170
2,456,419 A * 12/1948 Jackson ..... B65D 7/26 119/474
D158,567 S * 5/1950 Engstrom ..... D3/306
2,524,900 A * 10/1950 Einhorn ..... B65D 7/26 220/494
2,529,267 A * 11/1950 Sloane ..... B65D 7/26 211/181.1
2,600,439 A * 6/1952 Sloane ..... B65D 7/26 220/485
2,666,552 A * 1/1954 Coit, Jr. ..... B65D 19/12 108/53.5
2,799,423 A * 7/1957 Kaye ..... B65D 7/30 220/7
2,806,624 A * 9/1957 Beckner ..... B65D 19/12 220/485
2,821,047 A * 1/1958 Ruiz ..... A01K 69/06 220/6
2,896,793 A * 7/1959 Bogart, Jr. ..... A47F 5/13 211/132.1
2,919,045 A * 12/1959 Waugh ..... B65D 19/12 220/4.34
2,946,458 A * 7/1960 Miller ..... A47B 77/14 211/162
3,056,524 A * 10/1962 Stoecker ..... B65D 7/26 220/485
3,145,850 A * 8/1964 Ciborowski ..... A47F 5/01 108/27
3,252,583 A * 5/1966 Walther ..... A47B 81/04 211/119
3,269,556 A * 8/1966 Streater ..... A47F 5/01 108/147.17
3,273,952 A * 9/1966 Himelreich ..... A47B 88/9412 156/258
3,378,161 A * 4/1968 Lookabaugh ..... B65D 7/26 206/509
3,404,783 A * 10/1968 Whitman ..... A47F 5/0031 211/132.1
3,556,058 A * 1/1971 Smiler ..... A01K 31/08 119/474
3,627,163 A * 12/1971 Taylor ..... B65D 7/26 206/512
3,647,077 A * 3/1972 Gillespie ..... A47B 77/14 211/133.5
3,752,552 A * 8/1973 MacDonald ..... A47B 43/00 312/258
3,819,079 A * 6/1974 Levens ..... B65D 90/08 220/4.13
3,888,379 A * 6/1975 Folberth ..... B65D 7/30 217/43 A
3,901,572 A * 8/1975 Litchfield ..... A47B 88/941 312/111
4,062,607 A * 12/1977 Locatelli ..... A47B 63/00 312/258
4,106,626 A * 8/1978 Trubiano ..... B65D 7/26 206/513
4,113,131 A * 9/1978 Joseph ..... B65D 7/20 220/485
4,128,284 A * 12/1978 King ..... A47B 88/941 312/263
4,279,455 A * 7/1981 Santo ..... A47B 88/00 312/140
4,378,828 A * 4/1983 Shiminski ..... B25H 1/04 108/35
4,789,075 A * 12/1988 Sun ..... B65D 11/1846 206/508
D305,272 S * 12/1989 Remmers ..... D6/513
4,901,867 A * 2/1990 Petty, Jr. ..... A47B 31/04 211/46
4,925,258 A * 5/1990 Ludwig ..... A47B 88/944 211/184
5,036,990 A * 8/1991 Verchere ..... A47B 77/16 211/113
5,213,403 A * 5/1993 Lautenschlager .... A47B 88/427 312/140
5,443,173 A * 8/1995 Emery ..... B65D 7/20 220/481
5,618,091 A * 4/1997 Huber ..... A47B 88/941 312/265.5
D383,283 S * 9/1997 Hankins, III ..... D3/306
5,682,936 A * 11/1997 Higdon, Jr. ..... A47B 88/9412 144/345
5,803,295 A * 9/1998 Tussey ..... B65D 11/10 220/1.5
5,931,326 A * 8/1999 Weng ..... B65D 7/24 220/4.28
5,954,412 A * 9/1999 Rutherford ..... A01K 63/003 108/157.15
6,015,056 A * 1/2000 Overholt ..... B65D 11/1833 220/6
6,119,588 A * 9/2000 Tiemann ..... A47J 43/18 211/181.1
6,155,444 A * 12/2000 Liu ..... B65D 1/225 220/7
6,164,476 A * 12/2000 Rene ..... B65D 19/12 220/4.28
6,170,686 B1 * 1/2001 Flores ..... B65D 7/24 220/4.33
6,401,950 B1 * 6/2002 Chiang ..... B62B 3/005 220/1.5
6,497,331 B1 * 12/2002 Morandi ..... A47B 43/00 211/149
6,508,376 B1 * 1/2003 Chiang ..... B42F 15/0094 211/46
6,578,720 B1 * 6/2003 Wang ..... A47F 5/01 211/126.15
6,718,635 B2 * 4/2004 Cheng ..... A47B 55/02 220/485
6,726,045 B1 * 4/2004 Chen ..... A47B 47/0075 220/4.33
H2235 H * 4/2010 Manounian ..... D3/305
D615,328 S * 5/2010 Snider ..... D6/705.6
D617,591 S * 6/2010 Snider ..... D3/306
8,006,858 B2 * 8/2011 Cheng ..... A47B 55/02 220/485
8,511,767 B2 * 8/2013 Haidar ..... F25D 25/025 312/348.2
8,770,421 B2 * 7/2014 Hay ..... B65D 19/18 220/4.28
D710,124 S * 8/2014 Goodman ..... D3/306
D781,055 S * 3/2017 Hsu ..... D3/306
2002/0139798 A1 * 10/2002 Logan ..... B65D 7/30 220/7
2003/0164374 A1 * 9/2003 Orset ..... B65D 19/18 220/7
2004/0195943 A1 * 10/2004 Bowers ..... A47B 63/00 312/258
2005/0194382 A1 * 9/2005 B. ..... B65D 11/1833 220/7
2005/0269332 A1 * 12/2005 Svabeck ..... A47J 37/1295 220/485
2008/0074021 A1 * 3/2008 Croft ..... A47B 96/025 312/334.1
2009/0014444 A1 * 1/2009 Chung ..... B65D 7/26 220/6
2009/0090709 A1 * 4/2009 Shalomoff ..... B65D 11/1833 220/6
2009/0134157 A1 * 5/2009 Meers ..... B65D 11/184 220/7
2010/0294756 A1 * 11/2010 Lu ..... B62J 7/00 220/4.28
2011/0278287 A1 * 11/2011 Lin ..... B65D 9/14 220/4.29
2012/0074825 A1 * 3/2012 Armstrong ..... A47B 88/407 312/334.23
2012/0152946 A1 * 6/2012 Gronholm ..... B65D 19/10 220/6

(56) References Cited

U.S. PATENT DOCUMENTS

| | | | | |
|---|---|---|---|---|
| 2013/0049560 | A1* | 2/2013 | Liu | A47B 88/9412<br>312/348.1 |
| 2013/0106272 | A1* | 5/2013 | Chung | A47B 88/95<br>312/348.2 |
| 2013/0127316 | A1* | 5/2013 | Wu | A47B 88/9416<br>312/258 |
| 2014/0061143 | A1* | 3/2014 | Hu | A47B 88/40<br>211/133.5 |
| 2014/0312753 | A1* | 10/2014 | Courchaine | G02B 6/44<br>312/258 |

* cited by examiner

COLLAPSIBLE HANGING STORAGE ASSEMBLY

FIELD OF THE INVENTION

The present invention relates generally to a collapsible hanging storage assembly. More so, the present invention relates to a hanging storage assembly that is adapted to be hung beneath a desk or flat surface, and used as a general storage unit for storing and accessing letters, files, stationery, writing instruments, computer related devices, and other office related items; whereby the hanging storage assembly comprises panels that collapse for stowage and can be shipped in a disassembled condition, and also easily constructed by interlocking the various panels and fastening mechanisms that make up the hanging storage assembly.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Generally, there are numerous types, styles, constructions, and arrangements of storage units which are adapted to be placed on a desk, bookcase, or the like, which have a plurality of spaced, horizontal shelves for holding various materials such as letters, envelopes, stationery and incoming and outgoing mail. These storage units are formed of a variety of materials, such as wood, metal, plastic, or a combination thereof.

Typically, wire racks and shelves consists of wire mesh supported by metal supports and is intended to be load-bearing. The mesh is usually welded to the supports, but may be attached in other ways as well. In commercial and industrial applications, the wire mesh usually has a minimum wire gauge of 0.105 inches when round wire is used. The most common shelf size is 42 inches deep by 46 inches wide, while two such shelves placed side-by-side can usually be combined to allow for a single shelf of 8 feet wide.

Other proposals have involved desk trays. The problem with these storage trays is that they are not easily accessible from beneath a desk or flat surface. Even though the above cited storage units meets some of the needs of the market, a can rack assembly that provides a plurality of modular racks that serve to facilitate both the loading of cans and the presentation of the cans for removal by a consumer, while also enabling multiple modular racks to be configured into multiple stacked arrangements through the use of side panels comprising flat bars having convex and concave humps, and further brackets that help fasten the flat bars together is still desired.

SUMMARY

Illustrative embodiments of the disclosure are generally directed to a collapsible hanging storage assembly that is adapted to be mounted beneath or laterally to a desk and used as a desk tray for receiving letters, files, writing instruments, computer related devices, stationery, and other office related items. The hanging storage assembly may also be placed in an alternate position and serve as a general storage unit that conveniently hangs within reach under a desk or other flat surface. The hanging storage assembly comprises a variety of interlocking panels. The panels are collapsible for stowage, and easily assembled to enable containment of at least one item. When collapsed, the hanging storage assembly may be shipped in a disassembled condition. The fully assembled arrangement of panels hang beneath the desk or table for containing the items.

In some embodiments, the hanging storage assembly may include a base panel defined by wire mesh. In one embodiment, the wire mesh of the base panel has sufficient surface area to carry at least one item, such as paper, files, writing instruments, and office supplies. The base panel is further defined by a pair of side edges, a rear edge, and a front edge. In one embodiment, the edges of the base panel are disposed at the periphery of the wire mesh, so as to form a generally rectangular shape.

In some embodiments, the assembly comprises a pair of side panels defined by wire mesh. The pair of side panels hingedly join with the pair of side edges of the base panel. The side panels include a pair of upper horizontal bars and a pair of lower horizontal bars. The upper horizontal bars and the lower horizontal bars are in a spaced-apart relationship. The pair of lower horizontal bars hingedly join with the pair of side edges of the base panel.

The pair of side panels further comprise a pair of front vertical bars and a pair of rear vertical bars disposed in a perpendicular relationship with the upper and lower horizontal bars. In this manner, the base panel and the pair of side panels are configured to hingedly collapse in a coplanar relationship. In one embodiment, the bars of the side panels are disposed at the periphery of the wire mesh, so as to form a generally rectangular shape.

The assembly may also include at least one fastener disposed to extend from the pair of lower horizontal bars. The at least one fastener is configured to fasten the pair of lower horizontal bars to the pair of side edges of the base panel. In one embodiment, the fastener is an elongated clip integral with the lower horizontal bars.

The assembly may also include a pair of L-shaped brackets disposed to extend from the pair of front vertical bars. The L-shaped bracket may be configured to enable mounting of the assembly on a desk or other flat surface. The L-shaped brackets may include a vertical member and a generally flat horizontal member. The vertical and horizontal members are disposed about at a 90° relationship.

The vertical member may be integral with the pair of front vertical bars. The horizontal member is generally perpendicular with the vertical member, and also disposed in a parallel, spaced-apart relationship with the upper horizontal bars. The flat configuration of the horizontal member is configured to rest flush on a desktop or other flat surface, so as to enable the assembly to mount the side of a desk, table, and the like.

The assembly may also include a plurality of cylinders configured to join with the pair of rear vertical bars of the pair of side panels. The cylinders are disposed generally parallel with the pair of rear vertical bars. In one embodiment, the cylinders provide a fastening mechanism to detachably attach the side panels with a rear panel, discussed below.

The assembly may also include a rear panel defined by wire mesh. The rear panel is defined by an upper edge, a lower edge, a left edge, and a right edge. The edges of the rear panel are disposed at the periphery of the wire mesh, so as to form a generally rectangular shape. In some embodiments, a pair of hooks may extend from the left edge and the right edge of the rear panel. The hooks are configured to couple to the plurality of cylinders, so that the hooks enable detachable coupling between the rear panel and the pair of side panels.

Through this interlocking relationship between panels, the rear panel, the pair of side panels, and the rear panel are configured to be assembled to form a storage unit for containing at least one item. Further, the rear panel, the pair of side panels, and the rear panel are configured to collapse in a coplanar relationship to enable stowage.

In another aspect, the base panel is generally rectangular and flat.

In another aspect, the pair of side panels are generally rectangular and flat.

In another aspect, the rear panel is generally rectangular and flat.

In another aspect, the wire mesh is disposed in a parallel, spaced-apart relationship.

In yet another aspect, the wire mesh of the base panel is configured to enable carrying at least one item, such as paper, files, writing instruments, and office supplies.

In yet another aspect, the vertical member and a horizontal member of the pair of L-shaped brackets are disposed generally at a 90° relationship.

In yet another aspect, the pair of L-shaped brackets are configured to hang on a desk.

In yet another aspect, the at least one fastener comprises an elongated clip.

In yet another aspect, the at least one fastener is integral to the pair of lower horizontal bars.

In yet another aspect, the horizontal member of the L-shaped bar is configured to engage a desktop.

In yet another aspect, the cylinders are disposed generally in a center region of the pair of rear vertical bars.

In yet another aspect, the rear panel is disposed generally perpendicular to the base panel and the pair of side panels.

In yet another aspect, the pair of hooks are defined by a generally L-shape.

In yet another aspect, the assembly is fabricated from a lightweight metal or polymer.

One objective of the present invention is to hang a storage assembly beneath a desk, table, or flat surface to easily access items stored in the assembly.

Another objective is to configured the relationship between the panels to be collapsible, so that the assembly requires less space for a consumer to store the assembly, and also the shipping and packaging costs are reduced since the assembly requires less space, and therefore less packing material.

Another objective is to provide fasteners to enable detachable attachment between the pair of side panels and the base panel.

Another objective is to carry at least one item on the base panel.

Yet another objective is to collapse the rear panel, the pair of side panels, and the rear panel in a coplanar relationship for stowage.

Yet another objective is to assemble the rear panel, the pair of side panels, and the rear panel for containing the at least one item.

Yet another objective is to provide an inexpensive to manufacture collapsible hanging storage assembly.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A collapsible hanging storage assembly 100 is referenced in FIGS. 1-10. The collapsible hanging storage assembly 100, hereafter "assembly 100" is adapted to hang from a mounting surface 200, such as a desktop, table top, a flat surface, and the like, while containing at least one item. The assembly 100 has sufficient surface area and volume to store and enable easy dispensing of the item. Though in other embodiments, the assembly 100 may also be placed in an alternate position, such as on top of the desk or lateral to the desk, while still serving as a general storage unit that conveniently hangs within reach under a desk or other flat surface.

In one exemplary use, the assembly 100 is sized and dimensioned to form an easily accessible desk tray for holding letters, files, stationery, writing instruments, computer related devices, and other office related items. Further, a user sitting at a desk may easily store and access items directly beneath the desk top. Suitable materials for the assembly 100 may include, without limitation, a lightweight metal or polymer.

Figure 1:
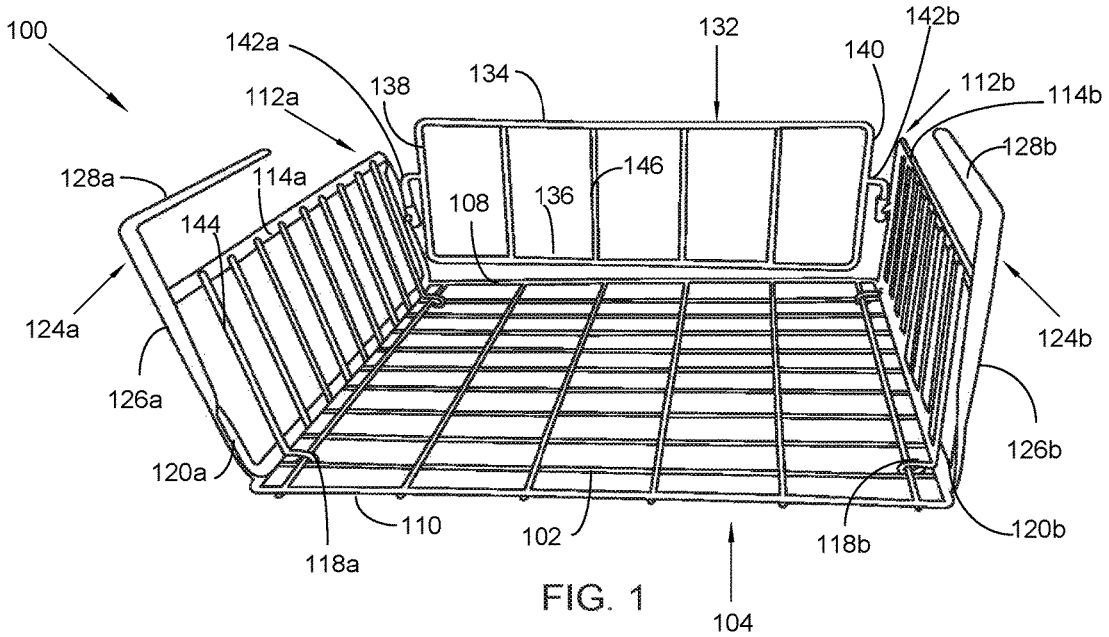
FIG. 1 illustrates a front perspective view of an exemplary collapsible hanging storage assembly, in accordance with an embodiment of the present invention.

As referenced in FIG. 1, the assembly 100 comprises a variety of interlocking panels 104, 112*a*, 112*b*, 132 and fastening mechanisms 118*a*, 118*b*, 130*a*, 130*b*, 142*a*, 142*b*. The panels 104, 112*a*, 112*b*, 132 are collapsible for stowage, and easily assembled to enable containment of at least one item. When collapsed, the hanging storage assembly 100 may be shipped in a disassembled condition. The fully constructed arrangement of panels hangs beneath the desk or table and has sufficient surface area and volume to contain the items in an easily accessible manner.

Figure 2:
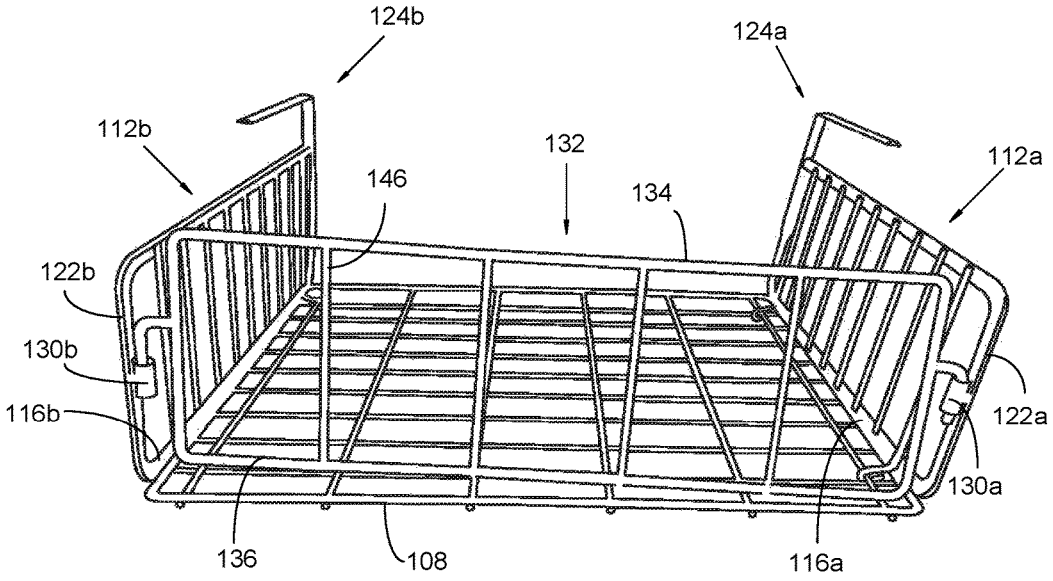
FIG. 2 illustrates a rear perspective view of the collapsible hanging storage assembly shown in FIG. 1, in accordance with an embodiment of the present invention.

In the rear view of FIG. 2, the assembly 100 is shown to have a base panel 104 defined by a generally flat, rectangular configuration and a base wire mesh 102. In one embodiment, the base wire mesh 102 of the base panel 104 has sufficient surface area to carry at least one item, such as paper, files, writing instruments, and office supplies. The base panel 104 is further defined by a pair of side edges 106*a*, 106*b*, a rear edge 108, and a front edge 110.

In one embodiment, the edges of the base panel 104 are disposed at the periphery of the base wire mesh 102, so as to form a generally rectangular shape. Though in other embodiments, other shapes may be used. The mesh may be welded to the edges, but may be attached in other ways as well. In some embodiments, the wire mesh may have a minimum wire gauge of 0.105 inches when round wire is used.

Figure 3:
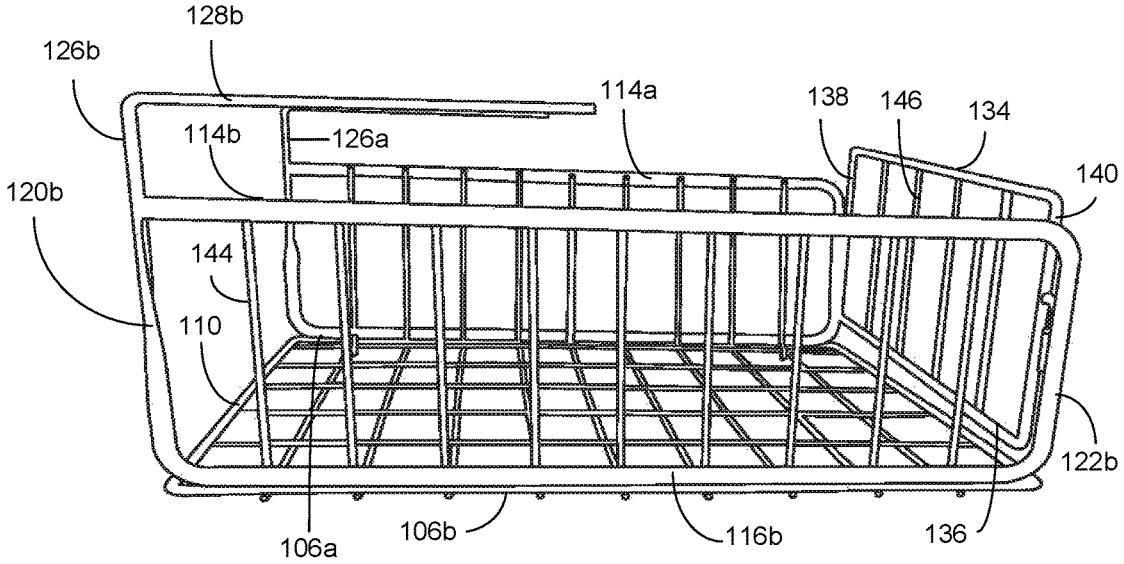
FIG. 3 illustrates an elevated side view of the collapsible hanging storage assembly shown in FIG. 1, in accordance with an embodiment of the present invention.

Looking now at FIG. 3, the assembly 100 comprises a pair of side panels 112*a*, 112*b* defined by a generally flat, rectangular configuration and a side wire mesh 144. The pair of side panels 112*a*, 112*b* hingedly join with the pair of side edges 106*a*, 106*b* from the base panel 104. The side panels 112*a*, 112*b* include a pair of upper horizontal bars 114*a*, 114*b* and a pair of lower horizontal bars 116*a*, 116*b* that form a parallel, spaced-apart relationship. The pair of lower horizontal bars 116*a*, 116*b* hingedly join with the pair of side edges 106*a*, 106*b* of the base panel 104. This junction enables hinged articulation up to 360°.

Figure 4:
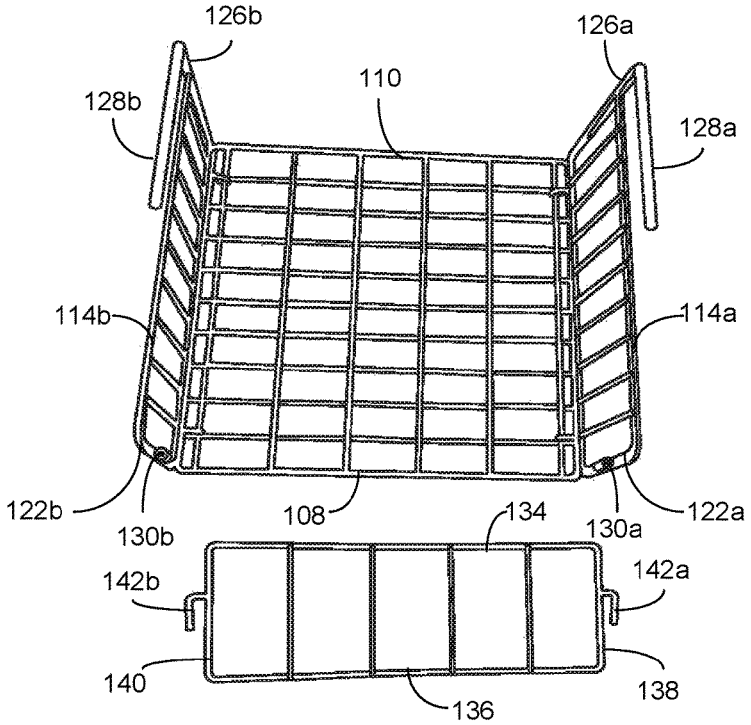
FIG. 4 illustrates a top view of a collapsible hanging storage assembly, showing a rear panel detached from a base panel, in accordance with an embodiment of the present invention.

As shown in FIG. 4, the pair of side panels 112*a*, 112*b* further comprise a pair of front vertical bars 120*a*, 120*b* and a pair of rear vertical bars 122*a*, 122*b* disposed in a perpendicular relationship with the upper and lower horizontal bars 116*a*, 116*b*. The horizontal and vertical bars may join to form a pair of rectangular, flat side panels 112*a*, 112*b*. In this manner, the base panel 104 and the pair of side panels 112*a*, 112*b* may be configured to hingedly collapse in a coplanar relationship. In one embodiment, the bars of the side panels 112*a*, 112*b* are disposed at the periphery of the side wire mesh 144, so as to form a generally rectangular shape.

Figure 5:
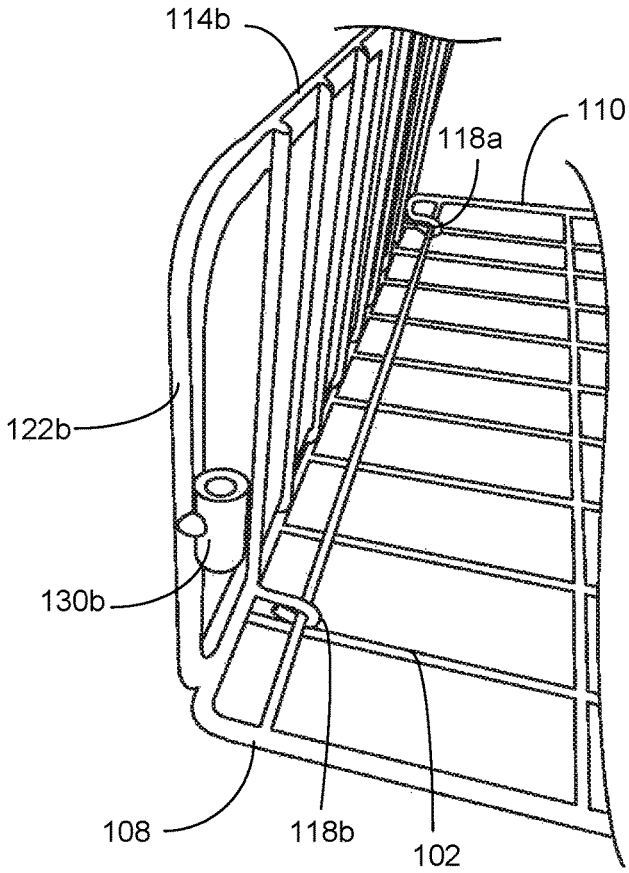
FIG. 5 illustrates a close up view of a cylinder on an exemplary side panel, in accordance with an embodiment of the present invention.

The close up view in FIG. 5 illustrates that at least one fastener 118*a*, 118*b* extends from the pair of lower horizontal bars 116*a*, 116*b*. The fastener 118*a*, 118*b* may be integral with the lower horizontal bars 116*a*, 116*b*. The at least one fastener 118*a*, 118*b* is configured to fasten the pair of lower horizontal bars 116*a*, 116*b* to the pair of side edges 106*a*, 106*b* of the base panel 104. In one embodiment, the fastener 118*a*, 118*b* is an elongated clip integral with the lower horizontal bars 116*a*, 116*b*. The fastener 118*a*, 118*b* may utilize a friction fit mechanism to secure the side panels 112*a*, 112*b* to the base panel 104, while allowing the hinged articulation therebetween.

The assembly 100 may also include a pair of L-shaped brackets 124*a*, 124*b* disposed to extend from the pair of front vertical bars 120*a*, 120*b*. The L-shaped bracket may be configured to enable mounting of the assembly 100 on the desktop or other flat surface. The L-shaped brackets 124*a*, 124*b* may include a vertical member 126*a*, 126*b* and a generally flat horizontal member 128*a*, 128*b*. The vertical and horizontal member 128*a*, 128*bs* are disposed about at a 90° relationship. Though in other embodiments, other angles may be used.

Figure 6:
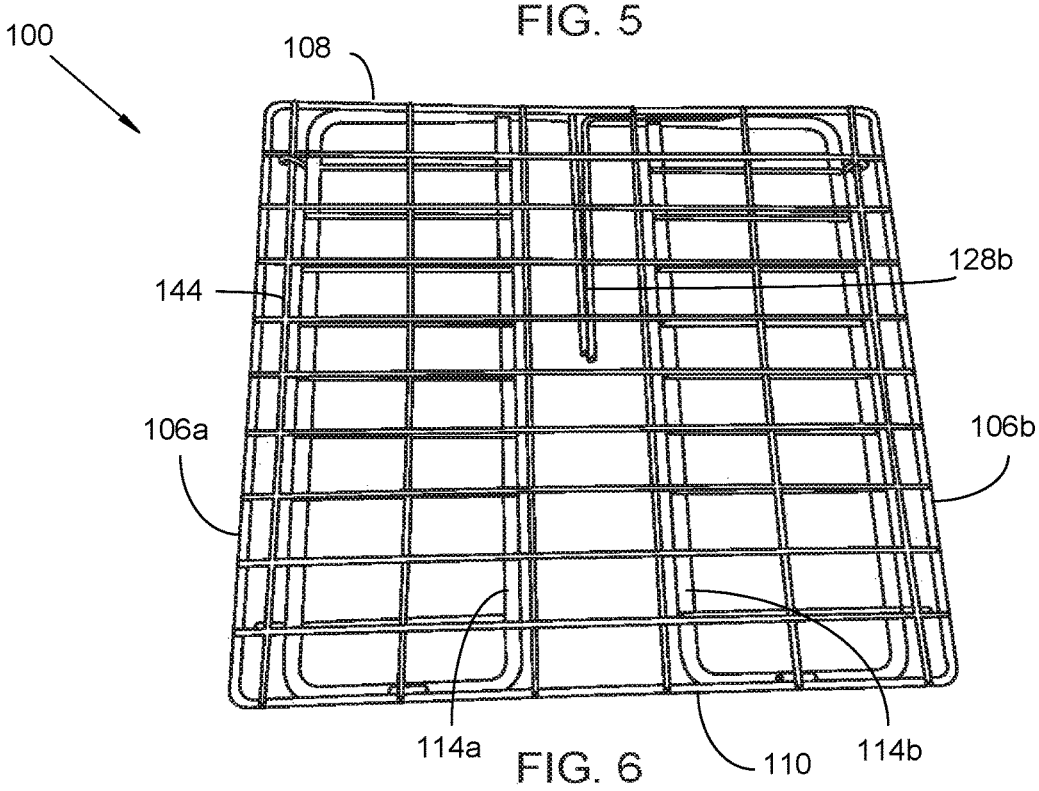
FIG. 6 illustrates a top view of a collapsible hanging storage assembly in a fully collapsed position, in accordance with an embodiment of the present invention.
Figure 7:
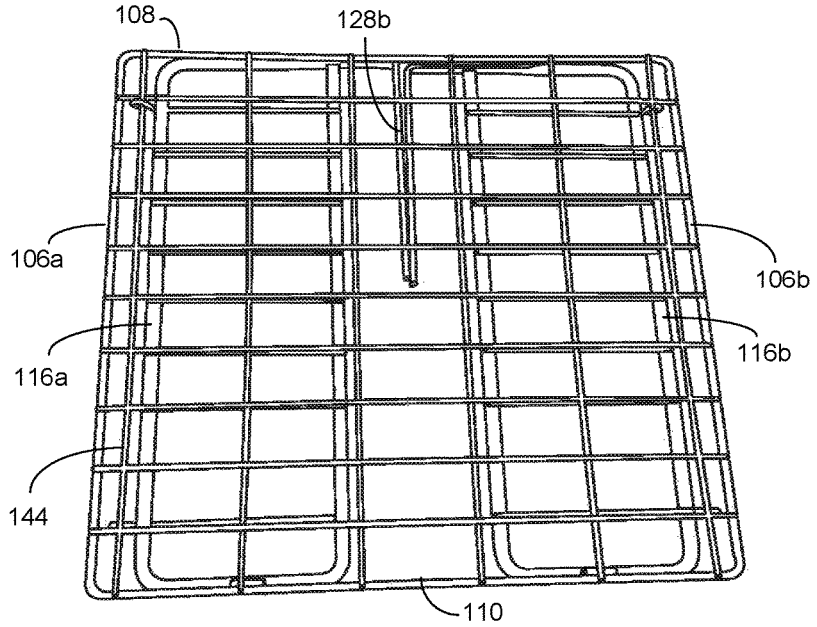
FIG. 7 illustrates a top view of a collapsible hanging storage assembly with a rear panel detached in a fully collapsed position, in accordance with an embodiment of the present invention.

As shown in the collapsed views of FIGS. 6 and 7, the vertical member 126*a*, 126*b* may be integral with the pair of front vertical bars 120*a*, 120*b*. The horizontal member 128*a*, 128*b* is generally perpendicular with the vertical member 126*a*, 126*b*, and also disposed in a parallel, spaced-apart relationship with the upper horizontal bars 114*a*, 114*b*. The flat configuration of the horizontal member 128*a*, 128*b* is configured to rest flush on a desktop or other flat surface, so as to enable the assembly 100 to mount the side of a desk, table, and the like.

The assembly 100 may also include a plurality of cylinders 130*a*, 130*b* configured to join with the pair of rear vertical bars 122*a*, 122*b* of the pair of side panels 112*a*, 112*b* (FIG. 5). The cylinders 130*a*, 130*b* are disposed generally parallel with the pair of rear vertical bars 122*a*, 122*b*. In one embodiment, the cylinders 130*a*, 130*b* provide a fastening mechanism to detachably attach the side panels 112*a*, 112*b* with a rear panel 132, discussed below. In one embodiment, one cylinder is used for each rear vertical bar.

Figure 8:
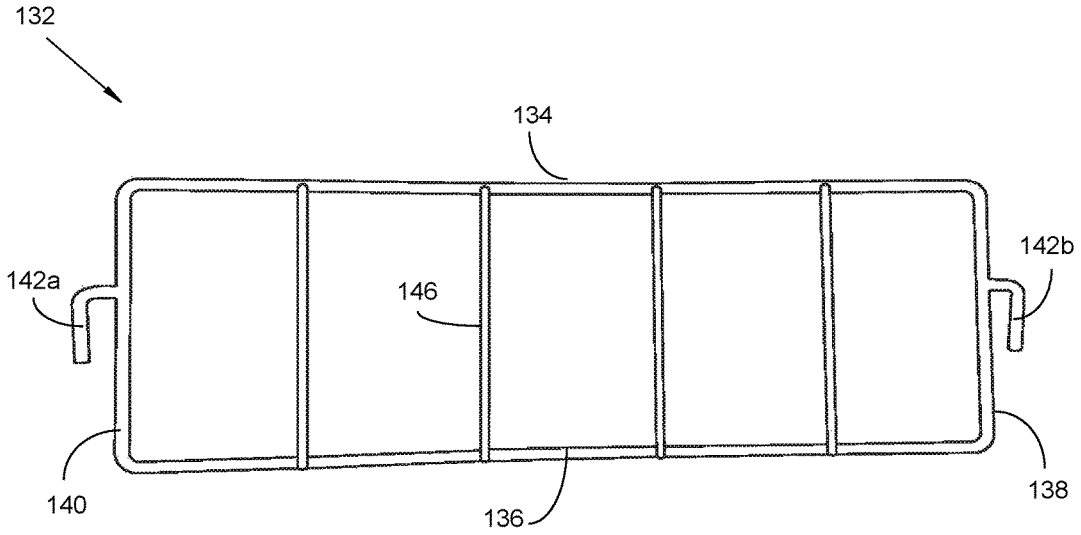
FIG. 8 illustrates an elevated side view of an exemplary rear panel, in accordance with an embodiment of the present invention.

As the elevated side view in FIG. 8 references, the assembly 100 may also include a rear panel 132 that hingedly joins with the pair of side panels 112*a*, 112*b*. The rear panel is defined by a generally flat, rectangular configuration and a rear wire mesh 146. The rear panel 132 is defined by an upper edge 134, a lower edge 136, a left edge 138, and a right edge 140. The edges of the rear panel 132 are disposed at the periphery of the rear wire mesh 146, so as to form a generally rectangular shape when attached to the side panels 112*a*, 112*b*. When hanging from the mounting surface, the rear panel 132 is the distally positioned panel.

Figure 9:
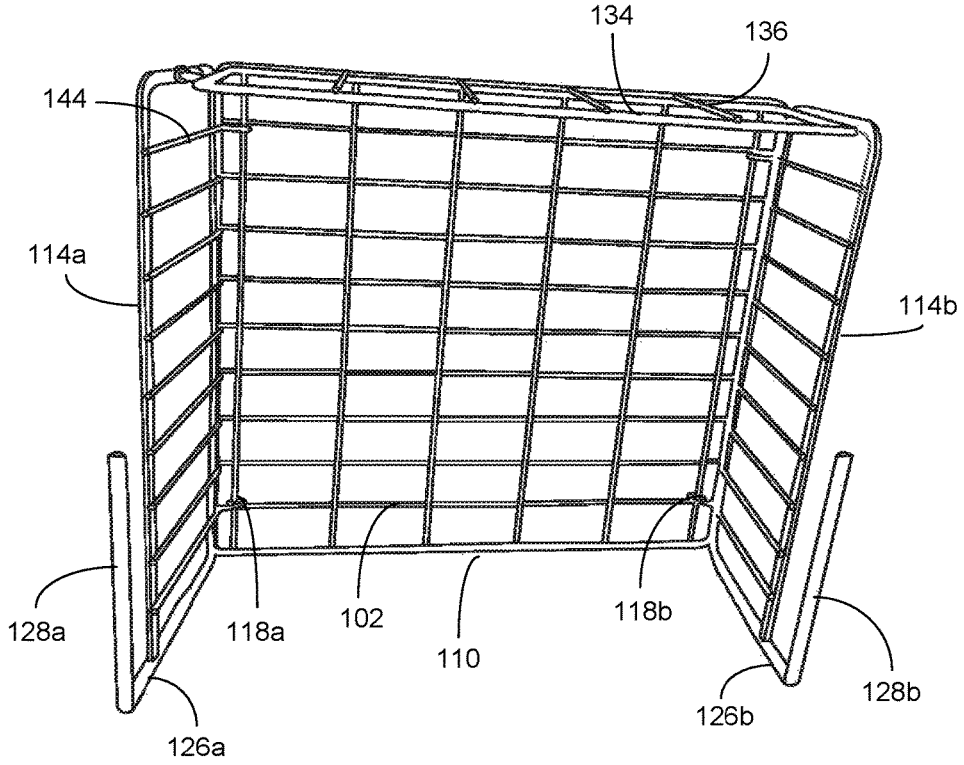
FIG. 9 illustrates a top view of a collapsible hanging storage assembly fully expanded, in accordance with an embodiment of the present invention.

As FIG. 9 illustrates, a pair of hooks 142*a*, 142*b* may extend from the left edge 138 and the right edge 140 of the rear panel 132. The hooks 142*a*, 142*b* are configured to couple to the plurality of cylinders 130*a*, 130*b*, so that the hooks 142*a*, 142*b* enable detachable coupling between the rear panel 132 and the pair of side panels 112*a*, 112*b*. In one embodiment, the hooks 142*a*, 142*b* have a generally L-shape. Though curved configurations may also be possible.

Figure 10:
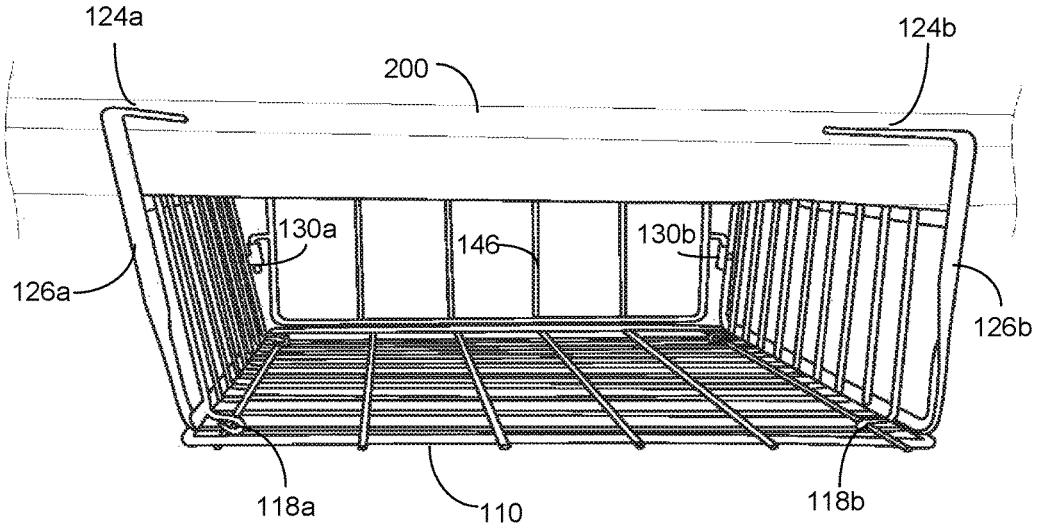
FIG. 10 illustrates a top view of a collapsible hanging storage assembly hanging from a desktop, in accordance with an embodiment of the present invention.

As depicted in FIG. 10, the assembly easily hangs on a flat mounting surface 200, such as a desktop when fully constructed. Through an interlocking relationship between panels 104, 112*a*, 112*b*, 132, the base panel 104, the pair of side panels 112*a*, 112*b*, and the rear panel 132 are easily assembled to form a storage unit having sufficient surface area and volume for containing the at least one item. Minimal tools and fasteners are required to construct the assembly 100.

Further as FIG. 6 illustrates, the base panel 104, the pair of side panels 112*a*, 112*b*, and the rear panel 132 are configured to collapse in a coplanar relationship to enable stowage and shipping. Because the panels 104, 112*a*, 112*b*, 132 are collapsible, the assembly 100 requires less space for a consumer to store the assembly 100, but also the shipping and packaging costs are reduced since the assembly 100 requires less space, and therefore less packing material.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A collapsible hanging storage assembly, the assembly consisting of:

a base panel defined by a pair of side edges, a rear edge, a front edge, and a base wire mesh disposed between the edges;

a pair of side panels each defined by a side wire mesh, the pair of side panels configured to hingedly join with the pair of side edges of the base panel, the pair of side panels comprising a pair of upper horizontal bars and a pair of lower horizontal bars, the pair of upper horizontal bars and the pair of lower horizontal bars disposed in a spaced-apart relationship, the pair of lower horizontal bars configured to hingedly join with the pair of side edges of the base panel, the pair of side panels further comprising a pair of front vertical bars and a pair of rear vertical bars disposed in a perpendicular relationship with the pair of upper horizontal bars and the pair of lower horizontal bars;

whereby the base panel and the pair of side panels are configured to hingedly collapse in a coplanar relationship;

at least one fastener disposed to extend from the pair of lower horizontal bars, the at least one fastener configured to fasten the pair of lower horizontal bars to the pair of side edges of the base panel; wherein the at least one fastener comprises an elongated clip;

a pair of L-shaped brackets disposed to extend from the pair of front vertical bars, the pair of L-shaped brackets configured to enable mounting of the assembly to a surface above the assembly in a suspended manner, the pair of L-shaped brackets comprising a vertical member and a generally flat horizontal member, the vertical member integral with the pair of front vertical bars, the horizontal member disposed generally perpendicular with the vertical member and further disposed in a parallel, spaced-apart relationship with the pair of upper horizontal bars;

a plurality of cylinders attached to the pair of rear vertical bars of the pair of side panels, the plurality of cylinders disposed generally parallel with the pair of rear vertical bars;

a rear panel defined by an upper edge, a lower edge, a left edge, a right edge, and a rear wire mesh disposed between the edges; and a pair of hooks disposed to extend from the left edge and the right edge of the rear panel, the pair of hooks are each defined by a generally L-shape, wherein the pair of hooks are configured to be inserted within the plurality of cylinders, and the pair of hooks are configured to enable detachable coupling between the rear panel and the pair of side panels;

whereby the rear panel, the pair of side panels, and the rear panel are configured to be joined in a perpendicular arrangement to enable the storage of items on the base panel between the side panels and the rear panel;

whereby the rear panel, the pair of side panels, and the rear panel are configured to collapse in a coplanar relationship to enable stowage of the assembly.

2. The assembly of claim 1, wherein the base panel is generally rectangular and flat.

3. The assembly of claim 1, wherein the pair of side panels are generally rectangular and flat.

4. The assembly of claim 1, wherein the rear panel is generally rectangular and flat.

5. The assembly of claim 1, wherein the vertical members and the horizontal members of the pair of L-shaped brackets are disposed generally at a 90° relationship respectively.

6. The assembly of claim 1, wherein the surface above the assembly is a generally flat mounting surface, a desktop, or a table top.

7. The assembly of claim 1, wherein the at least one fastener is integral with the pair of lower horizontal bars.

8. The assembly of claim 1, wherein the plurality of cylinders are disposed generally in a center region of the pair of rear vertical bars.

9. The assembly of claim 1, wherein the rear panel is disposed generally perpendicular to the base panel and the pair of side panels when the pair of hooks are inserted within the plurality of cylinders.

10. The assembly of claim 1, wherein the assembly is fabricated from a metal or polymer.

* * * * *